United States Patent [19]

Autry et al.

[11] Patent Number: 4,667,423

[45] Date of Patent: May 26, 1987

[54] RESILIENT COMPOSITE MIDSOLE AND METHOD OF MAKING

[75] Inventors: James C. Autry, Dallas, Tex.; Lin Yung-Mai, Taichung, China

[73] Assignee: Autry Industries, Inc., Dallas, Tex.

[21] Appl. No.: 738,223

[22] Filed: May 28, 1985

[51] Int. Cl.[4] ..... A43B 1/10

[52] U.S. Cl. ..... 36/102; 36/30 R; 36/25 R

[58] Field of Search ..... 36/102, 103, 104, 114, 36/25 R, 30 R, 31, 32 R

[56] References Cited

U.S. PATENT DOCUMENTS

| | | | |
|---|---|---|---|
| 2,314,237 | 3/1943 | Muller | 36/30 R |
| 2,363,995 | 11/1944 | Rollman et al. | 36/30 R |
| 2,478,664 | 8/1949 | Morrow et al. | 36/31 |
| 3,824,716 | 7/1974 | Di Paolo | 36/32 R |
| 4,393,605 | 7/1983 | Spreng | 36/114 |
| 4,498,251 | 2/1985 | Shin | 36/32 R X |
| 4,551,930 | 11/1985 | Graham et al. | 36/114 X |
| 4,559,723 | 12/1985 | Hamy et al. | 36/114 X |
| 4,561,140 | 12/1985 | Graham et al. | 36/30 R X |
| 4,562,651 | 1/1986 | Frederick et al. | 36/25 R X |

*Primary Examiner*—Henry S. Jaudon
*Assistant Examiner*—T. Graveline
*Attorney, Agent, or Firm*—Jerry W. Mills; Jefferson Perkins

[57] ABSTRACT

A midsole (18) is formed from a first, interior member (26) and a second, exterior member (28) molded around the top and sides of the first member (26). The first and second members (26) and (28) are formed of cushionable material and the second member (28) has a higher hardness and resiliency than the first member (26).

17 Claims, 5 Drawing Figures

RESILIENT COMPOSITE MIDSOLE AND METHOD OF MAKING

TECHNICAL FIELD OF THE INVENTION

The present invention relates to midsoles for athletic shoes, and more particularly to midsoles made out of a composite of different resilient materials.

BACKGROUND OF THE INVENTION

Conventional athletic or running shoes generally have at least three components. An outsole is usually fabricated of a fairly tough and only slightly cushionable material such as rubber. A midsole of more cushionable material is conventionally glued on top of the outsole, and an upper is attached on top of the midsole.

Conventionally, the midsole element in running or athletic shoes has been made of a single type of material. Some manufacturers have used ethylene vinyl acetate (EVA). Other manufacturers have used a midsole of polyurethane. Tests have proven that a midsole formed totally of EVA provides good cushioning, but is not sufficiently hard or resilient to provide proper support for the foot. On the other hand, midsoles made entirely of polyurethane are hard and unyielding with little cushioning provided.

Therefore, a need exists to provide a midsole which furnishes the wearer both proper support and provides him or her with an appropriate amount of cushioning.

SUMMARY OF THE INVENTION

The present invention comprises a midsole fabricated of two different components. A first interior member is constructed of a relatively cushionable material such as lhtlon, a type of EVA. A second member, fabricated of a harder, more resilient material, such as polyurethane, is molded around the sides and top of the first member. In a preferred embodiment, lateral stress bars are formed in the first and second members underneath the metatarsal-phalangeal junction of the foot, with the stress bars formed in the second member being generally aligned with the stress bars formed in the first member.

The midsole of the invention has been found to provide the wearer's foot with both proper support and proper cushioning.

BRIEF DESCRIPTION OF THE DRAWINGS

For a more complete understanding of the present invention and the advantages thereof, reference is now made to the accompanying Drawings in which.

DETAILED DESCRIPTION OF THE INVENTION

Figure 1:
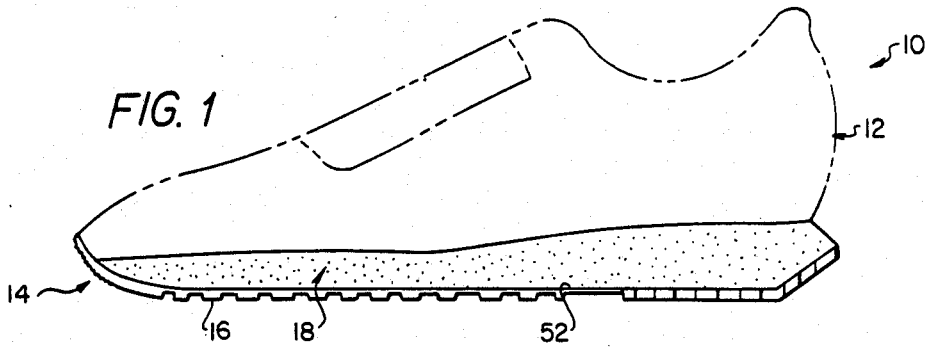
FIG. 1 is an elevation of a sole employing the midsole of the invention, with an upper shown in phantom.

Referring to FIG. 1, there is shown a shoe 10 employing the midsole of the invention. Shoe 10 has an upper 12, here shown in phantom, which can be constructed of leather or similar flexible material. A sole 14 comprises an outsole 16 and a midsole 18. Outsole 16 is fabricated of a relatively hard, durable material such as natural rubber. Midsole 18 is glued as a unit to outsole 16, and upper 12 is then glued to assembled sole unit 14.

Figure 2:
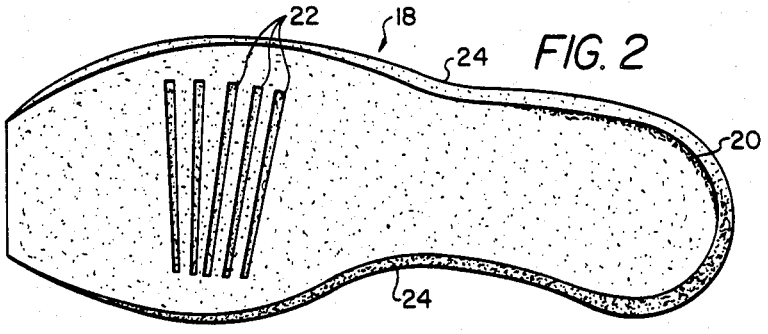
FIG. 2 is a top plan view of the midsole of FIG. 1, shown before assembly into the shoe.

Referring to FIG. 2, midsole 18 is shown by itself in plan view before assembly. Midsole 18 has a top 20 with a plurality of elongate indentations or stress bars 22 formed transversely in an area beneath the metatarsal-phalangeal junction of the foot. Midsole 18 has sloping sides 24 that slope outwardly from top 20 to a midsole bottom surface 25 (FIG. 3) in order to provide a stabilizing base to the wearer's foot. Top 20 generally conforms in its shape to the bottom surface of the wearer's foot.

Figure 3:
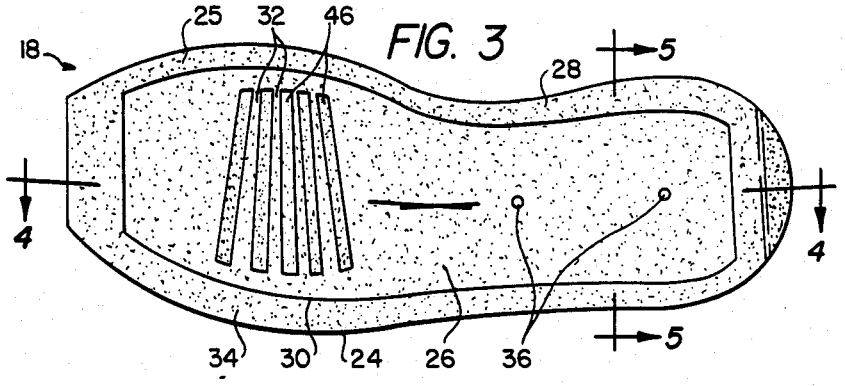
FIG. 3 is a bottom plan view of the midsole illustrated in FIG. 2.

FIG. 3 shows that midsole 18 is constructed of two different elements: an interior member 26 and an exterior member 28. Interior member 26 is smaller than exterior member 28 in every dimension. Lateral sides 30 of interior member 26 are completely enclosed by exterior member 28.

Interior member 26 is formed of a material that is more cushionable and less resilient than exterior member 28. In a preferred embodiment, interior member 26 is fabricated of lhtlon, an ethylene-rich form of EVA foam which has a hardness of about 45° on the Shore scale of hardness. Lhtlon is available from Ching-Shun Enterprises of Taiwan. Interior member 26 provides a cushioning element for the wearer's foot. However, because it is bounded on all sides by exterior member 28 and outsole 16 (FIG. 1), interior member 26 is restrained from excessive lateral or vertical deformation. This reduces sponginess and procudes a firmer support for the wearer's foot.

Interior member 26 has a series of stress bars 32 which are generally aligned with exterior member stress bars 22. Interior member sides 30 generally conform in their shape to exterior member sides 24, so as to define a lateral ring 34 of substantially uniform thickness around the margins of midsole 18. Exterior member 28 is formed of a relatively less cushionable, more resilient material such as polyurethane. A preferred embodiment of the invention uses a polyurethane having a hardness of about 55° to 60° for exterior member 28.

Midsole 18 is formed by suspending interior member 26 upside down in an injection mold, as by a pair of suspension members (not shown) connecting to suspension holes 36. Then, liquid polyurethane is injected into the mold around interior member 26 to form the exterior top 20 and sides 24 of the completed midsole. Preferably, interior member 26 is suspended in the injection mold such that the bottom surface 25 of exterior member 28 is flush with a bottom surface 37 of interior member 26. In an alternate embodiment, interior member 26 can be lowered into the injection mold such that exterior member 28 entirely covers it. After the polyurethane has been cooled, the assembled midsole is extracted from the mold. The top of the injection mold becomes bottom surface 25.

As shown by FIGS. 2 and 3, stress bars 22 and 32 radiate from the inner side of midsole 18 to the outer side in order to more closely conform with the lines of flexure of the wearer's foot.

Figure 4:
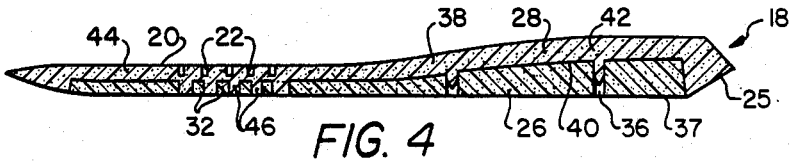
FIG. 4 is an elevational section taken substantially along line 4—4 of FIG. 3.

FIG. 4 illustrates an elevational section of midsole 18, showing the relative thicknesses of interior member 26 and exterior member 28. An external member layer 38 covers a top surface 40 of interior member 26 entirely. Interior member 26 extends longitudinally so as to be positioned under the plantar and heel surfaces of the foot. Member 26 thus receives and cushions the largest downward forces produced by the foot on sole 14. In an alternate embodiment, interior member 26 may extend longitudinally to only a fraction of the length of sole 14.

Midsole 18 has an elevated rear area 42 which raises the heel above the plantar region of the foot. This eases the stress on the Achilles tendon. The contour of interior top surface 40 generally follows the contour of exterior top surface 20 as it slopes down from the elevated heel region 42 to a plantar region 44. Exterior layer 38 and interior member 26 are about equally thick at any one longitudinal location.

FIG. 4 also more clearly illustrates the alignment of exterior member stress bars 22 with interior member stress bars 32. Before being placed in the injection mold, interior stress bars 32 are spaced from each other by air spaces or apertures 46 extending from interior bottom surface 37 to interior top surface 40. When introduced into the injection mold, liquid polyurethane will force its way into apertures 46. During flexure of the foot, the walls of exterior stress bars 22 deform inwardly, decreasing the air space therein. At the same time, stress bars 32, made of relatively more yieldable lhtlon, stretch longitudinally between filled-in apertures 46. The flexing actions of stress bars 22 and 32 provide a flexing joint for the metatarsal-phalangeal junction of the wearer's foot.

Bottom surfaces 25 and 37 conform to an upper surface 52 of outsole 16 (FIG. 1).

Figure 5:
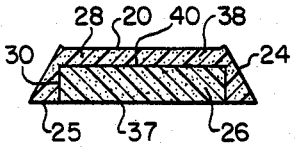
FIG. 5 is a transverse section taken substantially along line 5—5 of FIG. 2.

FIG. 5 is a transverse elevational section of midsole 18, showing the relative extent of interior member 26 and exterior member 28. Interior top surface 40 is laterally uniformly spaced from exterior top surface 20. Interior member 26 is sufficiently wide that most of the downward force of the foot placed on midsole 18 will communicate to interior member 26 in order to provide effective cushioning action. At the same time, top exterior layer 38 provides a resilient property to the same central region. Peripheral ring 34 prevents internal member 26 from excessively deforming in the laterial direction.

In summary, a novel midsole construction has been provided which supplies both cushioning and proper support to the foot of the wearer. An interior member is made of relatively cushionable material, and is surrounded on the top and sides by an exterior member of relatively greater resilience and structural integrity. This construction has proven to be superior to homogeneous constructions of either EVA or polyurethane.

Although a preferred embodiment of the present invention has been described in detail, it should be understood that various changes, substitutions and alterations can be made therein without departing from the spirit and scope of the invention as defined by the appended claims.

What is claimed is:

1. A midsole for a shoe, comprising:

a first member having a top and a plurality of sides;

a second member molded around the top and sides of said first member, said first and second members being formed of cushionable material, said second member having a higher hardness and resilience than said first member;

a plurality of elongate first member stress bars formed transversely in said first member in an area underneath the metatarsal-phalangeal region of the foot, a plurality of elongate second member stress bars formed in said second member in substantial alignment with said first member stress bars, such that an easily flexing joint of said midsole is formed in conformance with the flexure of the matatarsal-phalangeal junction of the foot.

2. The midsole of claim 1, wherein said second member forms a peripheral ring of substantially uniform thickness laterally around said first member.

3. The midsole of claim 1, wherein said first member is fabricated from lhtlon.

4. The midsole of claim 1, wherein said second member is fabricated from polyurethane.

5. The midsole of claim 1, wherein said second member has a top surface, a bottom surface and a plurality of exterior sides, said exterior sides sloping downwardly and outwardly from said second member top surface to said bottom surface.

6. The midsole of claim 1 wherein said second member has a top surface, a plantar region and a heel region, said top surface sloping downwardly longitudinally from the heel region to the plantar region.

7. The midsole of claim 6, wherein said first member has a top surface, the top surface of the first member sloping downwardly longitudinally in a manner substantially parallel to said second member top surface.

8. The midsole of claim 1, wherein said second member includes a top surface, said second member stress bars being formed transversely in said top surface as a plurality of elongate indentations.

9. The midsole of claim 8, wherein said stress bars are formed as segments of radial rays, the radial rays emanating from a point laterally inward from said midsole.

10. The midsole of claim 8, wherein said first member has a top surface and a bottom surface, said first member stress bars being divided from each other by elongate apertures between said first member top surface and said bottom surface.

11. The midsole of claim 10, wherein said first member stress bars are formed as segments of radial rays, said radial rays emanating from a point laterally inward from said midsole.

12. The midsole of claim 10, wherein said first member stress bars are filled with material forming said second member.

13. A method for fabricating a composite midsole allowing easy flexure of the metatarsal-phalangeal junction of the foot, comprising the steps of:

forming a first cushionable midsole member having a top and a plurality of sides, the first member further having a plurality of transverse stress bars, the stress bars being situated in an area underneath the metatarsal-phalangeal junction of the wearer's foot; and molding a second cushionable midsole member around the top and sides of the first member, a plurality of stress bars formed in the second member in substantial parallel alignment with the first member stress bars, the second member being harder and more resilient than the first member.

14. The method of claim 13, wherein the second member has a top surface and the first member has a top surface and a bottom surface, the method including the steps of:

forming the second member stress bars as a plurality of elongate indentations in the second member top surface;

forming a plurality of elongate apertures between the first member top surface and the first member bottom surface, the apertures defining the first member stress bars therebetween;

suspending the first member in a mold; and molding the second member around the first member, the material used to mold the second member invading the cavities.

15. The method of claim 13, wherein the stress bars are formed as segments in a plurality of radial rays, the rays emanating from a point laterally inward from the midsole.

16. The method of claim 13 wherein the second member has a bottom surface flush with a bottom surface of the first member.

17. The method of claim 13 wherein the first member is fabricated of lhtlon and the second member is fabricated of polyurethane.

* * * * *